United States Patent [19]

Aleshire

[11] Patent Number: 4,844,655

[45] Date of Patent: Jul. 4, 1989

[54] SURFACE DRAINAGE CONDUIT INSTALLATION STRUCTURE AND METHOD

[76] Inventor: Leonard C. Aleshire, 342 Warder St., Springfield, Ohio 45503

[21] Appl. No.: 20,540

[22] Filed: Mar. 2, 1987

[51] Int. Cl.[4] ..... E02B 5/00; E02B 11/00

[52] U.S. Cl. ..... 405/118; 405/155; 405/36; 52/742; 249/11; 249/177; 249/83

[58] Field of Search ..... 52/12, 19–21, 52/295, 743, 169.2, 169.3, 169.5, 741, 742; 404/2–5; 405/43–46, 118, 122, 123, 155; 249/2–6, 10, 11, 216, 218, 219 R, 83, 175, 177, 184; 264/333, 31, 35; 425/59, 63

[56] References Cited

U.S. PATENT DOCUMENTS

| | | | |
|---|---|---|---|
| 1,022,138 | 4/1912 | Holtz | 405/123 |
| 1,028,294 | 6/1912 | Simpson | 249/4 |
| 1,220,519 | 3/1917 | Lane | 405/122 |
| 1,514,884 | 11/1924 | Baxter et al. | 249/219 R |
| 2,639,549 | 5/1953 | Wubben et al. | 405/45 X |
| 2,917,804 | 12/1959 | Barron | 249/177 X |
| 2,978,779 | 4/1961 | Tatsch | 249/19 |
| 3,031,801 | 5/1962 | Leuthesser | 264/31 X |
| 3,228,679 | 1/1966 | Dees | 249/3 |
| 3,422,585 | 1/1969 | Dismukes | 249/219 R |
| 3,446,025 | 5/1969 | Koch | 405/43 |
| 3,929,944 | 12/1975 | Oliver | 264/34 |
| 4,066,237 | 1/1978 | Bentz | 249/213 |
| 4,374,078 | 2/1983 | Richardson | 264/35 |
| 4,498,807 | 2/1985 | Kirkpatrick et al. | 405/43 |
| 4,600,459 | 7/1986 | Proctor | 156/212 |

FOREIGN PATENT DOCUMENTS

| | | | |
|---|---|---|---|
| 254651 | 12/1911 | Fed. Rep. of Germany | 249/219 R |
| 133408 | 6/1929 | Switzerland | 249/3 |

OTHER PUBLICATIONS

Preform Trench Drain Co., Spillage Control at Bulk Plants.

ACO Drain, p. 13, Part II: Installation Notes, Site Preparation.

Polydrain, Inc., p. 15, Specifications.

Quazite, Installation Hints.

*Primary Examiner*—David A. Scherbel

*Assistant Examiner*—Michele Van Patten

*Attorney, Agent, or Firm*—Jacox & Meckstroth

[57] ABSTRACT

Structure and a method for installation of drain conduit whereby the drain conduit is positioned at a proper elevation with respect to an adjacent surface in a floor or parking lot or the like. The drain conduit is positioned within a trench. Support structure of this invention supports the drain conduit in the trench as concrete or other solidifiable material is poured into the trench to support and to secure the position of the drain conduit. Then after the concrete has partially solidified and is capable of support of the drain conduit, the support structure of this invention is removed and is reused in another installation.

8 Claims, 2 Drawing Sheets

SURFACE DRAINAGE CONDUIT INSTALLATION STRUCTURE AND METHOD

BACKGROUND OF THE INVENTION

Surface drain conduits are located below the surface of a floor, or a driveway, parking lot or the like. The surface drain conduit is customarily an elongate channel shape member which, when installed, is encompassed at the sides and bottom thereof with concrete or other solidifiable material.

For installation of the drain conduit, a trench is formed substance which supports the floor which is to receive the drain conduit. Then the drain conduit is positioned within the trench and supported in the desired location by some suitable means. Then concrete or other solidifiable material is poured into the trench and flows to a position below the drain conduit and to positions at the sides of the drain conduit as the trench is filled with the solidifiable material. Then the solidifiable material is permitted to solidify. Thus, the drain conduit is firmly positioned in the desired position with respect to the surface of the parking lot or floor or the like.

Conventionally, the drain conduit is a channel shaped member, and the upper surface of the drain conduit is positioned substantially at the same level as the surface of the floor or parking lot or the like. A suitable grate is positioned over the upper portion of the drain conduit to enclose the conduit, but to permit fluid to flow into the drain conduit.

Problems have long existed in regard to installation of a drain conduit. As stated above, a trench is formed into which the drain conduit is positioned. The drain conduit must be supported in a desired position within the trench while concrete is poured into the trench to fill the trench. The drain conduit must be maintained with the upper surface thereof substantially level with the surface of the driveway, floor, or parking lot or the like.

Several methods and devices have been employed for support of a drain conduit within a trench and to retain the drain conduit in desired position in the trench during pouring of concrete into the trench. Several types of support devices have been employed. Most of the known methods and devices have involved support devices placed in a trench. The drain conduit is placed upon the support devices. Then concrete is poured ito the trench, encompassing the support devices. The concrete is permitted to solidify to retain the drain conduit in the desired position. U.S. Pat. No. 4,498,807 is an illustration of such support device. When these support devices and methods are employed, the support devices are buried by the concrete in the trench, and the support devices are not recovered. Of course, the cost of such support devices is significant. Therefore, this conventional method is objectionable.

Another method of installation of drain conduits has been employed by which the drain tile is suspended within a trench by means of a support member which extends across the trench and which is supported by the surface at opposite sides of the trench. Such method enables some of the suspension elements to be recovered after the concrete is poured, but, because the drain conduit is supported within the trench, this method also presents problems in maintaining the desired position of the drain conduit during pouring of concrete into the trench. Furthermore, if the surface which supports the suspension elements is irregular, the surface may vary in elevation as it extends along the trench. Thus, in the use of this method and these devices, proper positioning of a drain conduit with respect to the surface along the trench may be difficult.

It is an object of this invention to provide support means and a method by which a drain conduit can be properly positioned and located within a trench and firmly supported during pouring of concrete into the trench for support and retention of the drain conduit by the concrete.

It is another object of this invention to provide such support means which can be easily and readily installed in a trench for support of a drain conduit.

Another object of this invention is to provide support means by which a drain conduit is securely supported in a trench during pouring of the concrete into the trench and in which the support means is removable after the concrete is poured and partially solidified.

It is another object of this invention to provide such support means which is easily and readily attachable to a drain conduit for support thereof.

It is another object of this invention to provide such support means by which is easily and readily adjustable to adjust the elevation of a drain conduit within an open trench.

Other objects and advantages of this invention reside in the construction of parts, the combination thereof, the method of production and the method of use, as will become more apparent from the following description.

SUMMARY OF THE INVENTION

This invention comprises structure and a method of supporting a drain conduit in a trench or the like during installation of the drain conduit in the trench and during pouring of concrete or the like, for permanent retention of the position of the drain conduit with respect to an adjacent surface.

Posts are driven into the floor of the trench. A hanger device is attached to the drain conduit and to the posts. Thus, the drain conduit is supported by the posts and by the hanger device in desired position within the trench and with respect to an adjacent surface.

Then concrete is poured into the trench to positions below and at the sides of the drain conduit. The concrete encompasses the portions of the posts which are in the trench. Then the concrete partially solidifies to a condition in which the concrete is capable of supporting the drain conduit and maintaining the position of the drain conduit in the trench. When this condition of the concrete occurs, the posts are withdrawn from the trench and from the concrete, and the hanger device is removed from the drain conduit. The concrete continues to solidify and secures the position of the drain conduit.

BRIEF DESCRIPTION OF THE VIEWS OF THE DRAWINGS

FIG. 5 is also a sectional view taken substantially on line 5—5 of FIG. 1.

DETAILED DESCRIPTION OF THE PREFERRED EMBODIMENT

Figure 1:
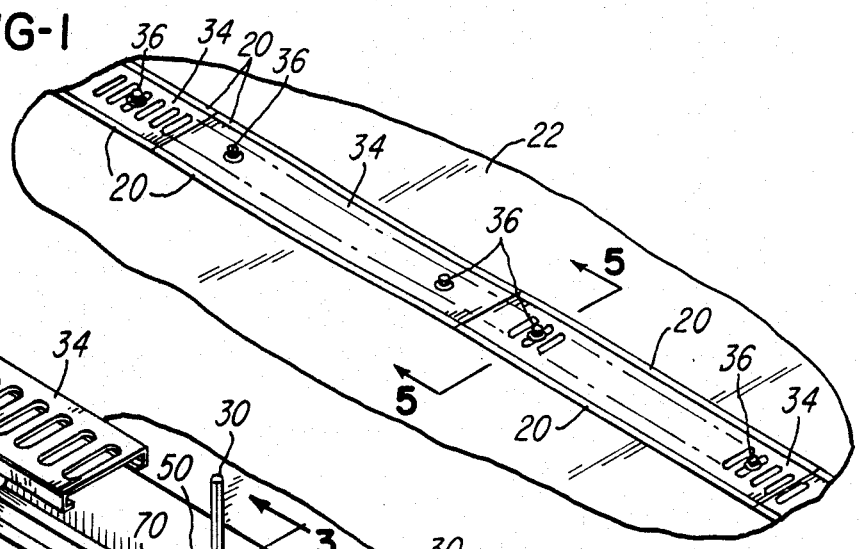
FIG. 1 is a perspective fragmentary top view of the upper surface of a drain conduit as the drain conduit is embedded within a parking lot or floor or driveway or the like. This view shows a grate at the upper surface of the drain conduit and enclosing the drain conduit.

FIG. 1 shows the upper portion of a drain conduit 20 which is embedded within a parking lot, or driveway, or floor or the like. Herein, the drain conduit 20 is considered as being embedded within a floor 22. The upper portion of the drain conduit 20 is shown substantially level with the surface of the floor 22.

Figure 5:
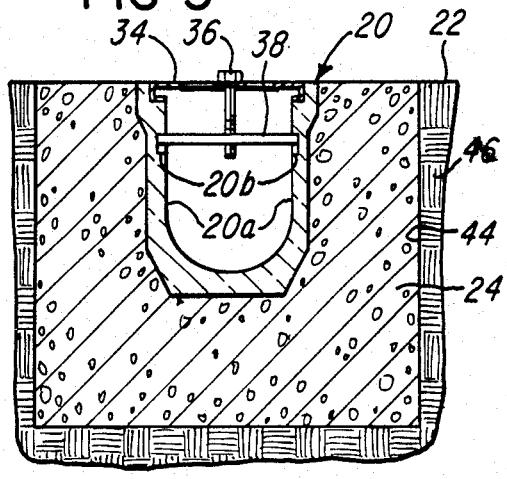
FIG. 5 is a sectional view, similar to FIGS. 3 and 4, showing the drain conduit and the concrete after the support posts and hanger structure of this invention have been removed.
Figure 6:
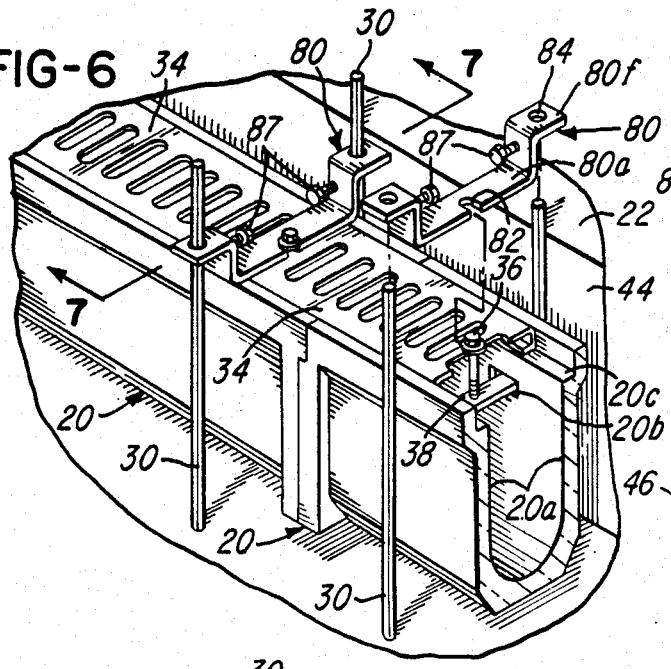
FIG. 6 is a fragmentary perspective view illustrating the structure and method of this invention and showing another embodiment of a portion of the support structure of this invention.

As shown in FIG. 5, after installation, the drain conduit 20 is supported by solidified concrete 24 which partially encompasses the drain conduit 20. The concrete 24 supports the drain conduit 20 so that the upper part of the drain conduit 20 is substantially level with the surface of the floor 22.

The drain conduit 20 is elongate and is shown as having a generally U-shape in cross section, formed by a pair of spaced-apart side portions 20*a*. At spaced-apart positions along the length of the drain conduit 20 are notches or recesses 20*b* within the side portions 20*a*. Covering the upper part of the drain conduit 20 is an elongate grate 34 which rests upon ledge portions 20*c*, best shown in FIG. 2, at the upper part of the side portions 20*a* of the drain conduit 20. The grate 34 is retained in position upon the ledge portions 20*c* by means of a bolt 36 which extends through the grate 34 and which is attached to a bar 38 which extends between the side portions 20*a* and which has the ends thereof within the recesses 20*b*, as illustrated in FIG. 5. The bolt 36 is threadedly adjustably attached to the bar 38, so that the grate 34 can be firmly drawn into engagement with the ledge portions 20*c*. Thus, the grate 34 is secured against detachment from drain conduit 20.

Figure 2:
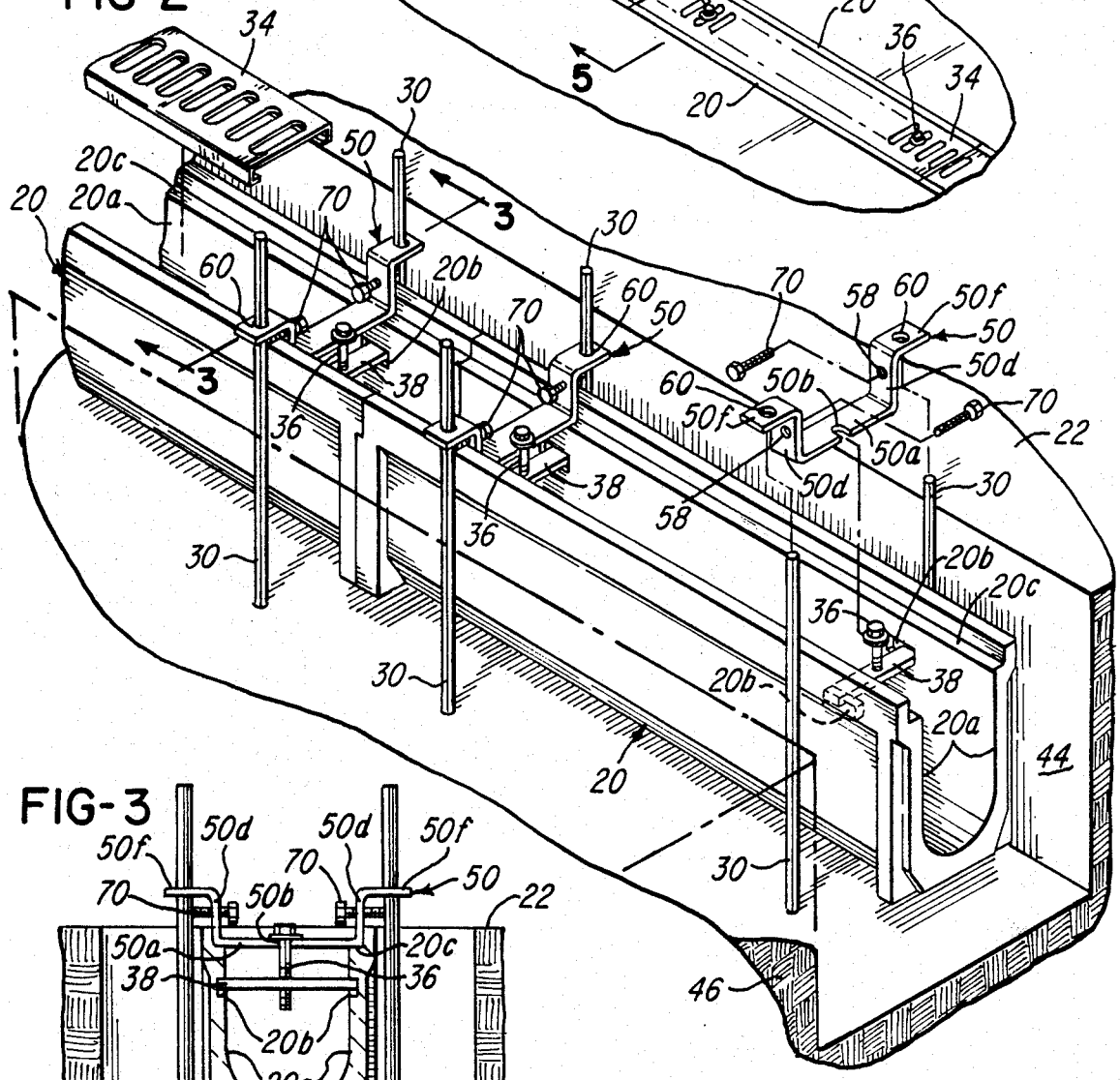
FIG. 2 is a perspective view, drawn on a much larger scale than FIG. 1 illustrating the positioning of a drain conduit within a trench and illustrating the structure and method of this invention for support of the drain conduit within the trench prior to the pouring of concrete into the trench.
Figure 3:
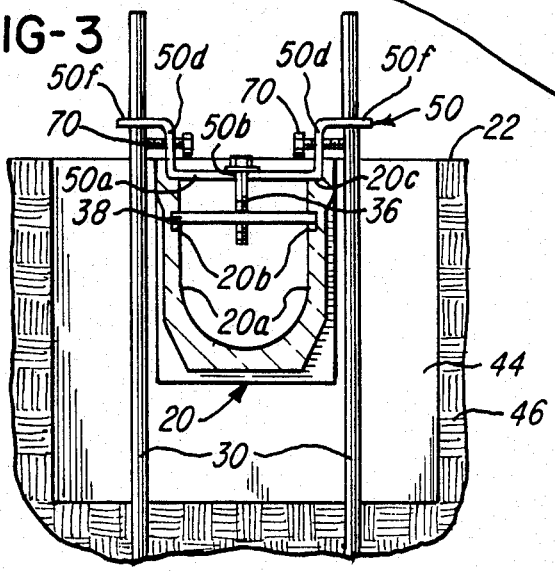
FIG. 3 is a sectional view, taken substantially on line 3—3 of FIG. 2.

Installation of the drain conduit 20 below the surface of the floor 22 is illustrated in FIGS. 2, 3, 4, and 5. A trench 44 is formed in material 46 which is below the surface of the floor 22. Support posts 30 are driven into the lower part of the trench 44, as illustrated in FIGS. 2 and 3. Then a bar 38, is positioned within the recesses 20*b* of the side portions 20*a* of a drain conduit 20, as shown in FIGS. 2 and 3. Then a bracket 50 is positioned upon the upper part of the drain conduit 20. The bracket 50 has a cross portion 50*a* which snugly fits upon the ledges portions 20*c* of the drain conduit 20, as the cross postion 50*a* extends between the side portions 20*a*. The cross portion 50*a* has a notch or opening 50*b* therein.

The bracket 50 has a pair of upwardly extending portions 50*d* which extend upwardly from the cross portion 50*a*. Each of the upwardly extending portions 50*d* has a threaded opening 58 therein. Extending laterally from the upwardly extending portions 50*d* are wing portions 50*f*. Each of the wing portions 50*f* has an aperture 60 therethrough, as best shown in FIG. 2.

A bolt 36 is positioned within the notch or opening 50*b* in the cross portion 50*a*, and the bolt 36 is threaded into the bar 38 which extends between side portions 20*a* of the drain conduit 20. The bolt 36 is tightened to firmly maintain the position of the bracket 50 with respect to the drain conduit 20.

For installation, the bracket 50 is moved downwardly with respect to the posts 30, as the posts 30 extend through the openings 60 in the wing portions 50*f* of the bracket 50. As the drain conduit 20 is attached to the bracket 50 by means of the bar 38 and the bolt 36, the drain conduit 20 is lowered between the posts 30 as the bracket 50 moves downwardly with respect. to the posts 30. Locking screws 70 are threadedly inserted into the threaded openings 58 of the upwardly extending portions 50*d* of the bracket 50. When the drain conduit 20 is properly positioned with respect to the surface of the floor 22 the locking screws 70 are tightened upon the posts 30, as shown in FIGS. 2 and 3.

Figure 4:
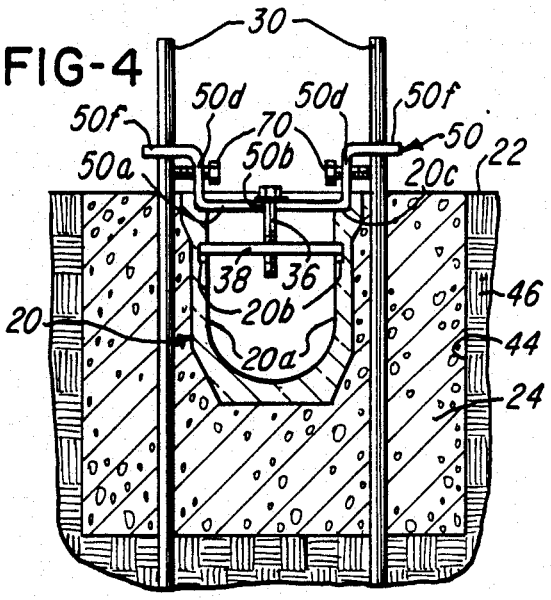
FIG. 4 is a sectional view similar to FIG. 3, but showing concrete within the trench and at the bottom and sides of the drain conduit soon after the concrete has been poured into the trench.

Then concrete 24 is poured into the trench 44, as illustrated in FIG. 4. As shown, the cross portion 50*a* has ends thereof which snugly fit within the ledge portions 20*c* of the drain conduit 20. The cross portion 50*a* thus retains the side portions 20*a* against the pressure of the concrete 24 and maintains the proper spacing between the side portion 20*a*, so that the grate 34 can fit upon the ledge portions 20*c*.

After the concrete 24 has partially solidified, the locking screws 70 are loosened from engagement with the posts 30, and the bolt 36 is loosened from the bar 38. Then the bracket 50 is removed from the drain conduit 20. Then the posts 30 are removed from the concrete 24. The concrete continues to solidify, with the drain conduit 20 in proper position with respect to the surface of the floor 22. Then, the grate 34 is positioned upon the ledge portions 20*c* and the bolt 36 is inserted into the bar 38 and the grate 34 is secured to the drain conduit 20, as shown in FIG. 5.

FIGS. 6–9

FIGS. 6–9 show a bracket 80 which has a cross portion 80*a* which has sufficient length to engage the upper surface of the drain conduit 20 and to bridge between the side portions 20*a* of the drain conduit 20. A notch or opening 82 is within the cross portion 80*a*. The bracket 80 has a pair of wing portions 80*f*, each of which has an aperture 84 therethrough.

The bracket 80 is employed in a manner similar to that discussed above with respect to the bracket 50. However, preferably, when the bracket 80 is employed, the grate 34 is positioned upon the ledge portions 20*c* of the drain conduit 20, as shown in FIGS. 6–9. The cross portion 80*a* of the bracket 80 is positioned upon the grate 34. A bolt 36 is inserted through the notch or opening 82 in the cross portion 80*a* and through the grate 34 and into a bar 38. The bar 38 has the ends thereof within the recesses 20*b* in the side portions 20*a* of the drain conduit 20. The bolt 36 is tightened to secure the bracket 80 upon the drain conduit 20.

Posts 30 are driven into the bottom of the trench 44, as described above and as shown in FIG. 7. Then the bracket 80 with the drain conduit 20 attached thereto is lowered upon the posts 30 as the posts 30 extend through the apertures 84 in the wing portions 80*f*.

Figure 7:
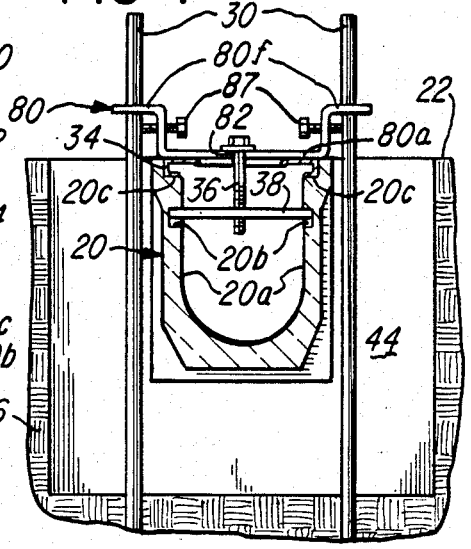
FIG. 7 is a sectional view taken substantially on line 7—7 of FIG. 6.

The bracket 80 and the drain conduit 20 are lowered with respect to the posts 30 until the upper surface of the drain conduit 20 is properly positioned with respect to the upper surface of the trench 44 or with respect to an adjacent surface. Then locking screws 87, which are threadedly attached to the bracket 80, are threadedly moved into engagement with the posts 30. Thus, the bracket 80 and the drain conduit 20 are secured in desired positions with respect to the upper surface of the trench 44, as shown in FIG. 7.

Figure 8:
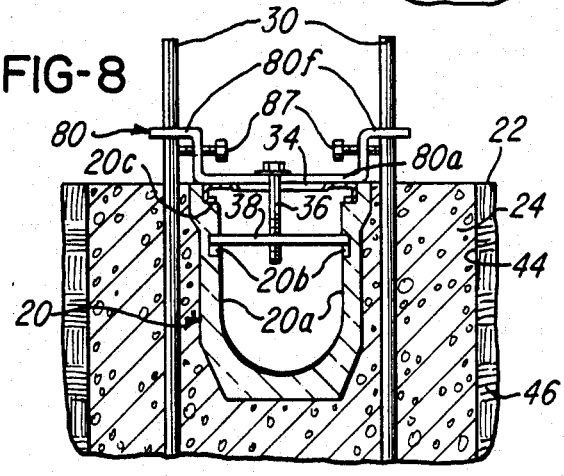
FIG. 8 is a fragmentary sectional view similar to FIGS. 6 and 7, showing concrete within the trench soon after the concrete has been poured into the trench.
Figure 9:
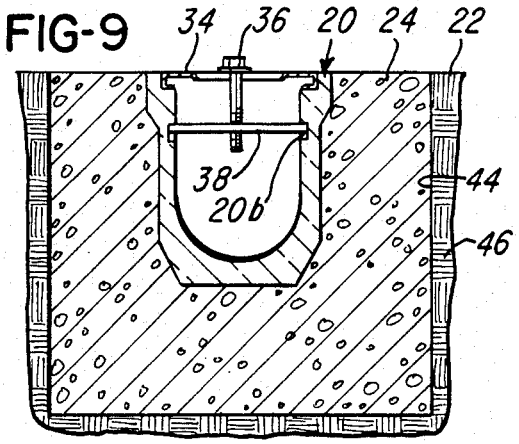
FIG. 9 is a sectional view, similar to FIGS. 6, 7, and 8, and showing the drain conduit and the concrete following removal of the support structure from the trench.

Then concrete 24 is poured into the trench 44 and flows to positions below the drain conduit 20 and at the sides of the drain conduit 20, as shown in FIG. 8. Then after the concrete 24 is partially solidified and capable of support of the drain conduit 20, the locking screws 87 are loosened, and the bolt 36 is loosened and the bracket 80 is removed from the drain conduit 20 and from the posts 30. Then the posts 30 are withdrawn from the trench 44 and from the concrete 24. Then the bolt 36 is threadedly inserted further into the bar 38, as shown in FIG. 9. Thus, the grate 34 is secured upon the drain conduit 20, and the drain conduit 20 and the grate 34 are located as shown in FIG. 9.

Thus, in summary, a drain conduit can be properly and accurately and firmly located within a trench and with respect to an adjacent surface of a floor or the like. During installation, the position of the drain conduit within the trench is readily adjusted as the drain conduit is supported by the posts. The posts and the support bracket are removed after the concrete has partially solidified. Thus, the posts and the support bracket are reusable.

Although the preferred embodiment of the surface drainage conduit installation structure and method of this invention has been described, it will be understood that within the purview of this invention various changes may be made in the form, details, proportion and arrangement of parts, the combination thereof, and the method of installation, which generally stated consist in a structure and method within the scope of the appended claims.

The invention having thus been described, the following is claim:

1. A method of supporting a rigid drain conduit in a trench during installation of the drain conduit in the trench to locate the drain conduit in a desired elevation and at a desired position with respect to a surface which is adjacent the trench, the trench having a given depth, the rigid drain conduit having spaced-apart side walls and a bottom wall, the side walls and the bottom wall of the drain conduit having exterior surfaces, the trench having a bottom floor, comprising:

providing a post which has a length greater than the given depth of the trench, positioning a portion of the post below the bottom floor of the trench, with the post extending upwardly within the trench, to a position above the trench so that the post has a lower portion below the trench and an upper portion above the trench, followed by placing the drain conduit into the trench at a position closely adjacent the post and at a desired position with respect to a surface adjacent the trench, followed by providing connection means and attaching the connection means to the spaced-apart side walls of the drain conduit, followed by attaching the connection means to the post, whereby the post supports the connection means and the drain conduit at a desired elevation and at a desired position with respect to a surface adjacent the trench, followed by pouring a solidifiable support substance into the trench to positions in which the solidifiable support substance engages the exterior surface of the bottom wall of the drain conduit and the exterior surfaces of the side walls of the drain conduit, followed by permitting the solidifiable support substance to partially solidify to a condition in which the solidifiable support substance is capable of supporting the drain conduit, without support by the post and the connection means, followed by removing the connection means from the side walls of the drain conduit and from the post, followed by grasping the upper portion of the post and lifting the post and removing the post from the solidifiable support substance and from the trench, and followed by permitting the solidifiable support substance to completely solidify, whereby the drain conduit is secured by the solidified support substance at a desired elevation and at a desired position with respect to a surface adjacent the trench.

2. The method of claim 1 in which the side walls of the drain conduit are provided with openings therein and wherein the step of attaching connection means to the side walls of the drain conduit includes positioning a portion of the connection means within the openings of the side walls of the drain conduit.

3. Reusable structure for supporting a drain conduit within a trench and with respect to a surface adjacent the trench during installation of the drain conduit, the trench having a bottom floor, the trench having a given depth at the position of the structure, the drain conduit having a generally U-shape cross-sectional configuration with upwardly extending spaced-apart walls, each of the walls of the drain conduit having a recess therein, a solidifiable support material being employed to permanently support the drain conduit and to secure the position of the drain conduit, comprising:

a bracket provided with a connection portion, an elongate bar, attachment means for attaching the elongate bar to the bracket for support of the elongate bar by the bracket, the elongate bar having portions which are positionable within the recesses of the walls of a drain conduit for support of the drain conduit by the bar and by the bracket, elongate-post means positionable within the trench closely adjacent the drain conduit, the post means having a length greater than the depth of the trench, the post means having a length sufficient to extend from a position below the bottom floor of the trench to a position above the trench, the post means being adapted to be positioned within the trench with a portion of the post means significantly below the bottom floor of the trench and with the post means extending upwardly from the floor of the trench and closely adjacent the drain conduit to a position above the trench, and connection means carried by the connection portion of the bracket and connectable to the post means for support of the bracket and the drain conduit by the post means at a position above the floor of the trench, whereby the elongate bar is attached to the drain conduit, and the bracket is attached to the elongate bar and to the post means, as the post means extends from a position below the bottom floor of the trench to a position above the trench, and whereby the drain conduit is temporarily supported within the trench by the elongate bar and by the bracket and by the post means, as the drain conduit is supported and positioned above the floor of the trench and at a desired position with respect to an adjacent surface of the trench, and whereby a solidifiable support material is poured into the trench to permanently support the drain conduit, and whereby the solidifiable support material is permitted to solidify to support the drain conduit, the post means and the bracket and the elongate bar being removed from the drain conduit and from the trench after the solidifiable support material has partially solidified and is capable of support of the drain conduit and prior to complete solidification of the solidifiable support material.

4. The structure of claim 3 in which the bracket includes a cross portion which is adapted to extend between the spaced-apart walls of the drain conduit and engage the walls of the drain conduit adjacent the upper portion of the walls to retain the position of the drain conduit with respect to the bracket.

5. Reusable support structure for supporting a drain conduit within a trench, for proper location of the drain conduit with respect to a surface adjacent the trench during installation of the drain conduit within the trench, the drain conduit being elongate and having opposed side portions provided with spaced-apart recesses, the trench having a bottom floor portion, the trench having a given depth at the position of the structure, the trench being adapted to receive solidifiable concrete, to permanently support the drain conduit, the support structure comprising:

a pair of elongate posts vertically positionable within the trench, the posts having a length significantly greater than the depth of the trench, whereby the posts extend from a position below the bottom floor portion of the trench to a position above the trench, the posts being positionable closely adjacent the opposed side portions of the drain conduit, the support structure also comprising a bracket including attachment means for attachment of the bracket to the pair of posts, a support member provided with portions positionable within the spaced-apart recesses of the drain conduit, means for attaching the support member to the bracket for support of the drain conduit above the bottom floor of the trench as the drain conduit is positioned between the vertically oriented posts, the drain conduit thus being supported by the support structure in the desired position thereof as the drain conduit is supported by the support structure within the trench above the bottom floor of the trench and maintained at a desired position with respect to a surface adjacent the trench, the trench being adapted to receive solidifiable concrete for permanent support of the drain conduit, and whereby the support member is removed from the drain conduit and the posts are removed from the concrete when the concrete has partially solidified, and is capable of support of the drain conduit.

6. A method of installation of a drain conduit in a trench which has a bottom floor of soil material and in which the trench has a given depth at a given location, to locate the drain conduit in a desired elevation and at a desired position with respect to a surface adjacent the trench, the trench having a bottom floor, comprising:

providing an elongate post which has a length significantly greater than the depth of the trench, positioning the elongate post substantially vertically within the trench including positioning a portion of the post below the floor of the trench, whereby the post is supported within the soil material of the bottom floor of the trench and whereby the post extends from a position below the bottom floor of the trench to a position above the trench, followed by positioning the drain conduit at a position above the floor of the trench and adjacent the elongate post, followed by attaching the drain conduit to the post above the floor of the trench and at a desired position with respect to a surface adjacent the trench, whereby the drain conduit is supported by the post within the trench above the floor of the trench and at a desired position with respect to a surface adjacent the trench, followed by pouring a solidifiable support substance into the trench to positions below the drain conduit and to positions in engagement with the drain conduit, followed by permitting the solidifiable support substance to partially solidify to a condition in which the solidifiable support substance supports the drain conduit, followed by releasing the post from attachment to the drain conduit, and removing the post from the solidifiable support substance and from the trench after the solidifiable support substance has partially solidified and is capable of support of the drain conduit, and followed by permitting the solidifiable support substance to completely solidify, whereby the drain conduit is secured in desired elevation and in a desired position with respect to an adjacent surface.

7. The method of claim 6 in which the drain conduit has a pair of spaced-apart walls and in which each of the walls has an opening therein, and in which the step of attaching the drain conduit to the post includes positioning support means within the opening of each of the spaced-apart walls.

8. A support structure which is reusable for installation of a drain conduit member within a trench and for proper location of a drain conduit member with respect to a surface adjacent the trench, the drain conduit member having spaced-apart walls provided with recesses therein, the trench having a bottom floor portion, the trench having a given depth at the position of the structure, the trench being adapted to receive solidifiable concrete to permanently support and retain the drain conduit, comprising:

a pair of posts adapted to be substantially vertically oriented within the trench with the drain conduit member between the posts, each of the posts having a length significantly greater than the depth of the trench, whereby the posts extend from a position below the bottom floor portion of the trench to a position above the trench, an elongate support member having portions positionable within the recesses of the walls of the drain conduit member, connection means attachable to the elongate support member and to the posts, whereby the drain conduit member is supported above the bottom floor portion of the trench by the elongate support member and by the posts as the drain conduit member is positioned between the posts, the drain conduit member thus being supported in the desired position thereof as the drain conduit member is within the trench and at a desired position with respect to a surface adjacent the trench, the trench being adapted to receive solidifiable concrete for engagement with the drain conduit for permanent support of the drain conduit, and whereby the elongate support member is removed from the posts, and the posts are removed from the concrete and from the trench when the concreate has partially solidified and is capable of support of the drain conduit.

* * * * *